United States Patent [19]

Suzuki

[11] Patent Number: 5,060,622

[45] Date of Patent: Oct. 29, 1991

[54] SUPERCHARGED MOTOR VEHICLE

[75] Inventor: Takamitsu Suzuki, Iwata, Japan

[73] Assignee: Yamaha Hatsudoki Kabushiki Kaisha, Iwata, Japan

[21] Appl. No.: 577,811

[22] Filed: Sep. 4, 1990

Related U.S. Application Data

[62] Division of Ser. No. 312,600, Feb. 17, 1989, abandoned.

[30] Foreign Application Priority Data

Feb. 18, 1988 [JP] Japan ..... 63-35485
Oct. 27, 1988 [JP] Japan ..... 63-271486

[51] Int. Cl.[5] ..... F02B 33/00
[52] U.S. Cl. ..... 123/559.1
[58] Field of Search ..... 123/559.1, 561

[56] References Cited

U.S. PATENT DOCUMENTS

| | | | |
|---|---|---|---|
| 1,479,993 | 1/1924 | Kirkham | 123/559.1 |
| 2,091,356 | 8/1937 | Fawcett | 123/561 |
| 2,098,718 | 11/1937 | Caminez et al. | 123/559.1 X |
| 2,362,493 | 11/1944 | Lowther | 123/559.1 |
| 2,467,077 | 4/1949 | Brunken | 123/561 |
| 2,949,902 | 8/1960 | Calovolo | 123/559.1 X |
| 4,723,526 | 2/1988 | Horiuchi et al. | 123/559.1 |

FOREIGN PATENT DOCUMENTS

| | | | |
|---|---|---|---|
| 1013437 | 4/1952 | France | 123/559.1 |
| 66816 | 4/1986 | Japan | 123/561 |
| 220927 | 10/1986 | Japan . | |
| 471319 | 9/1937 | United Kingdom | 123/559.1 |
| 671152 | 4/1952 | United Kingdom | 123/559.1 |

*Primary Examiner*—Michael Koczo
*Attorney, Agent, or Firm*—Ernest A. Beutler

[57] ABSTRACT

Several embodiments of supercharged V-type engines wherein at least one plenum chamber is provided that is disposed adjacent at least one of the banks of the cylinders. A supercharger is positioned at the transmission end of the engine and is interconnected with the plenum chamber through a relatively short conduit. In some embodiments, the supercharger is driven from the transmission and in other embodiments, the supercharger is driven from the opposite end of the engine. In one embodiment, there are a pair of plenum chambers, each disposed above a respective cylinder bank.

4 Claims, 7 Drawing Sheets

SUPERCHARGED MOTOR VEHICLE

This is a division of U.S. patent application Ser. No. 312,600, filed Feb. 17, 1989, abandoned.

BACKGROUND OF THE INVENTION

This invention relates to a supercharged motor vehicle and more particularly to an improved arrangement for supercharging an internal combustion engine.

The use of superchargers as a means for increasing the power of an internal combustion without increasing its displacement is well known. With multi-cylinder engines, it is desirable to have the supercharger discharge its output into a plenum chamber which, in turn, delivers the pressurized air and/or fuel mixture to the individual cylinders of the engine. The use of the plenum chamber is desirable to insure that the pressure delivered to the cylinders is equal. However, such an arrangement presents certain difficulties, primarily in the placement of the various components and the driving of the supercharger. With modern motor vehicles and particularly those embodying transverse engine front wheel drive, the placement difficulties become magnified. For example, it is desirable to place the plenum chamber as close to the cylinders as possible to insure that it will perform its intended function. Also, it is desirable to maintain a relatively short conduit that runs from the supercharger outlet to the plenum chamber so as to reduce pumping losses. However, these problems are particularly difficult in the environment as aforedescribed.

In addition to the problems in connection with laying out of the conduits and plenum chamber for the induction system, the driving arrangement for the supercharger also presents certain difficulties.

Normally, a variety of accessories are driven by the engine and when a supercharger is also driven by the engine, the driving arrangements for all of the accessories and supercharger can become quite complicated. In addition, the location of the drive for the supercharger to some extent dictates where the supercharger will be positioned and this further aggravates the layout problems previously described.

It is, therefore, a principal object of this invention to provide an improved and compact arrangement for a supercharged internal combustion engine.

It is a further object of this invention to provide an arrangement for supercharging a multiple cylinder engine wherein a plenum chamber is incorporated in the induction system and wherein the conduitry between the supercharger plenum and plenum chamber and intake ports is simplified.

It is a further object of this invention to provide an improved and simplified driving arrangement for a supercharged internal combustion engine.

SUMMARY OF THE INVENTION

A first feature of this invention is adapted to be embodied in an internal combustion engine that has a plurality of aligned cylinders and a transmission at one end of the engine which is driven by the engine. A plenum chamber extends along one side of the cylinder and a supercharger is positioned at the transmission end of the engine and is driven by the engine. Conduit means interconnect the output of the supercharger with the plenum chamber at the transmission end of the engine.

Another feature of the invention is adapted to be embodied in a drive arrangement for a supercharged internal combustion engine which engine has a transmission and a clutch for selectively coupling the transmission input shaft to the output shaft of the engine. In accordance with this feature of the invention, the supercharger is driven by the transmission and hence is not driven when the clutch is disengaged.

DETAILED DESCRIPTION OF THE PREFERRED EMBODIMENTS

Figure 1:
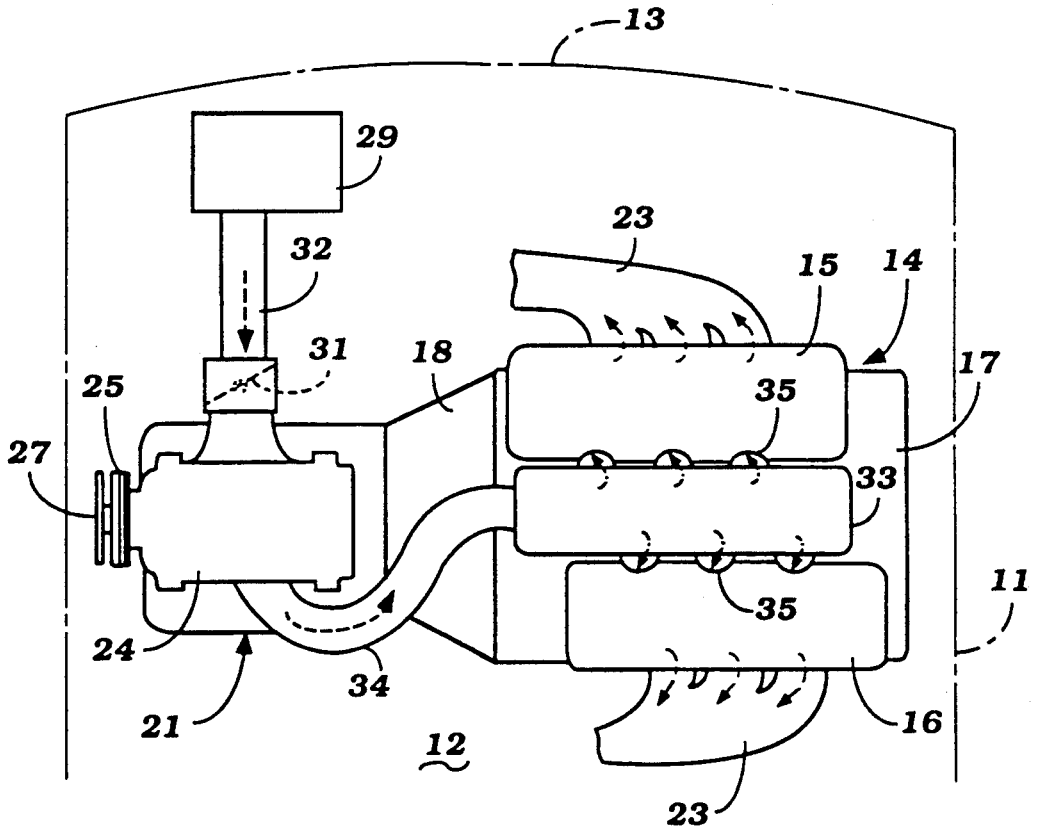
FIG. 1 is a top plan view of the engine compartment of a motor vehicle powered by an internal combustion engine constructed in accordance with a first embodiment of the invention.
Figure 2:
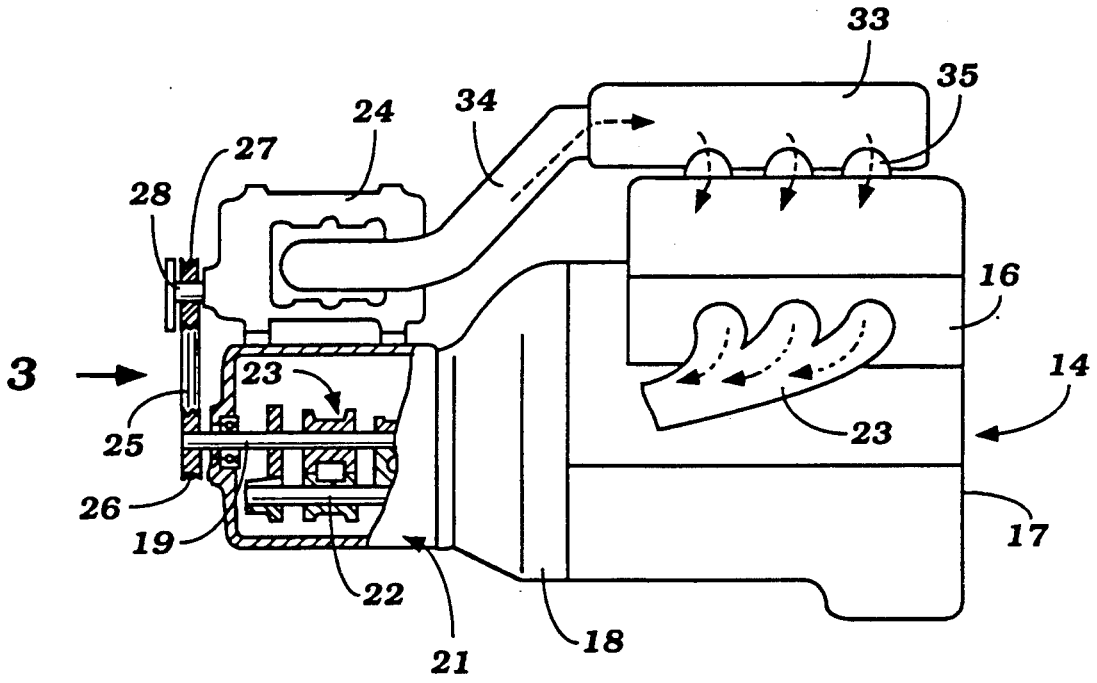
FIG. 2 is an enlarged side elevational view of the engine, with a portion broken away.
Figure 3:
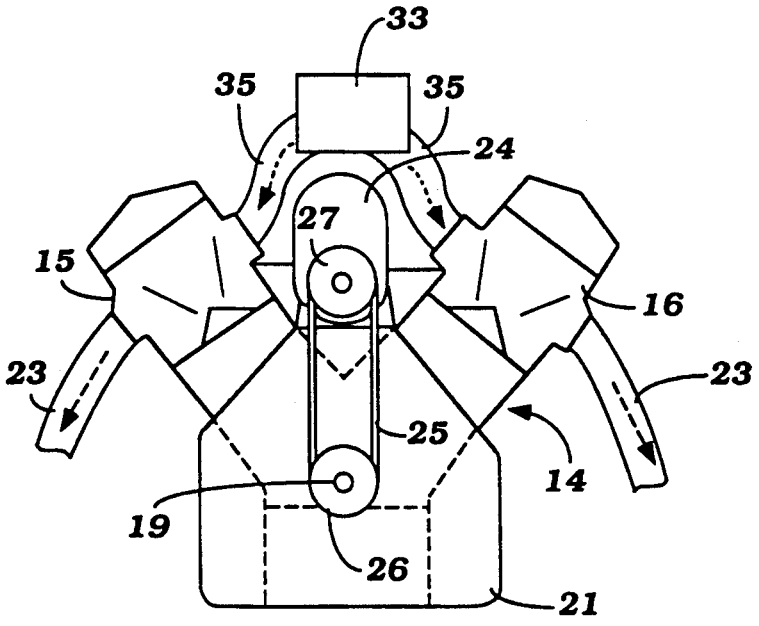
FIG. 3 is a rear elevational view of the engine looking in the direction of the arrow 3 in FIG. 2.
Figure 4:
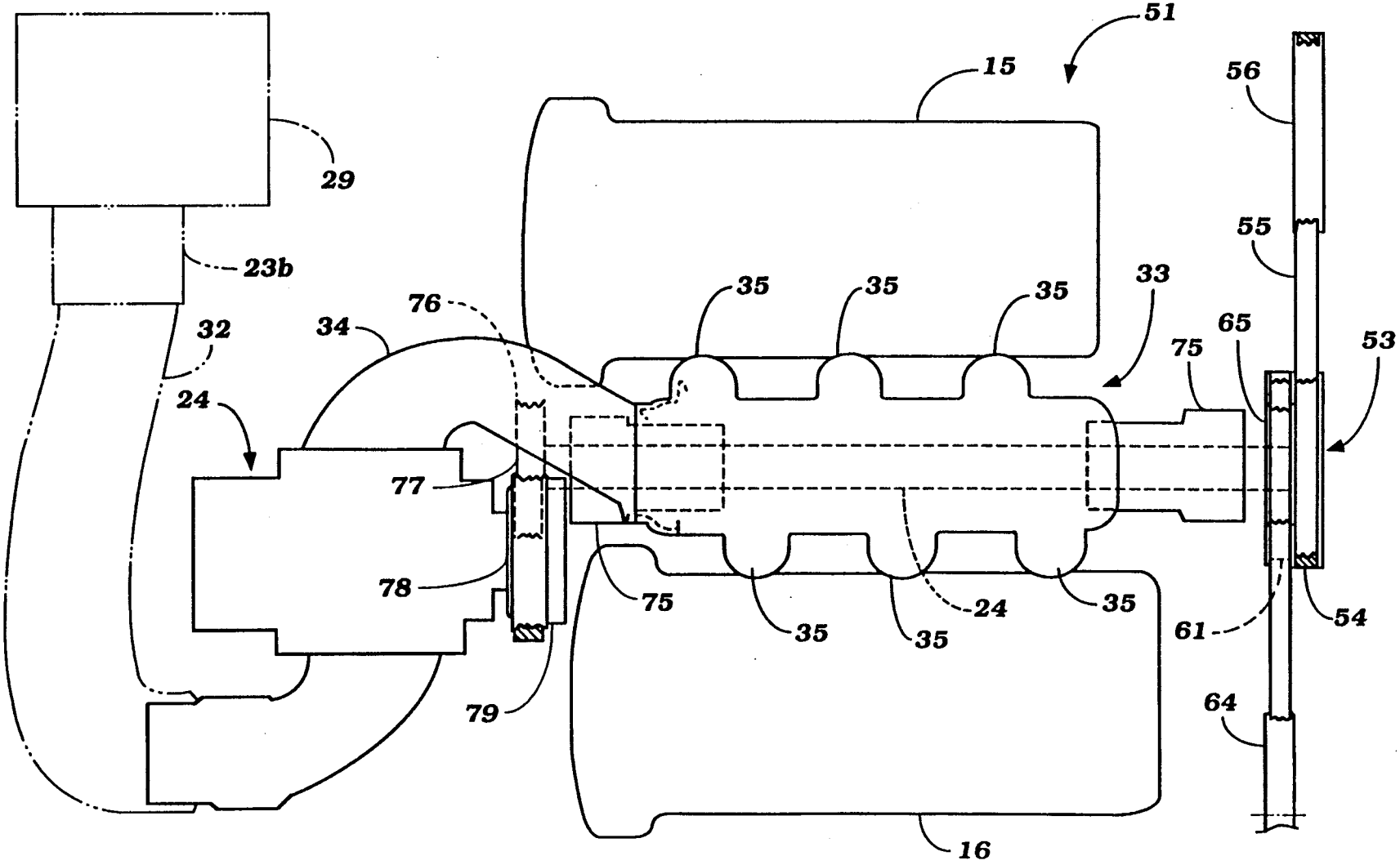
FIG. 4 is a top plan view of an internal combustion engine constructed in accordance with another embodiment of the invention.
Figure 5:
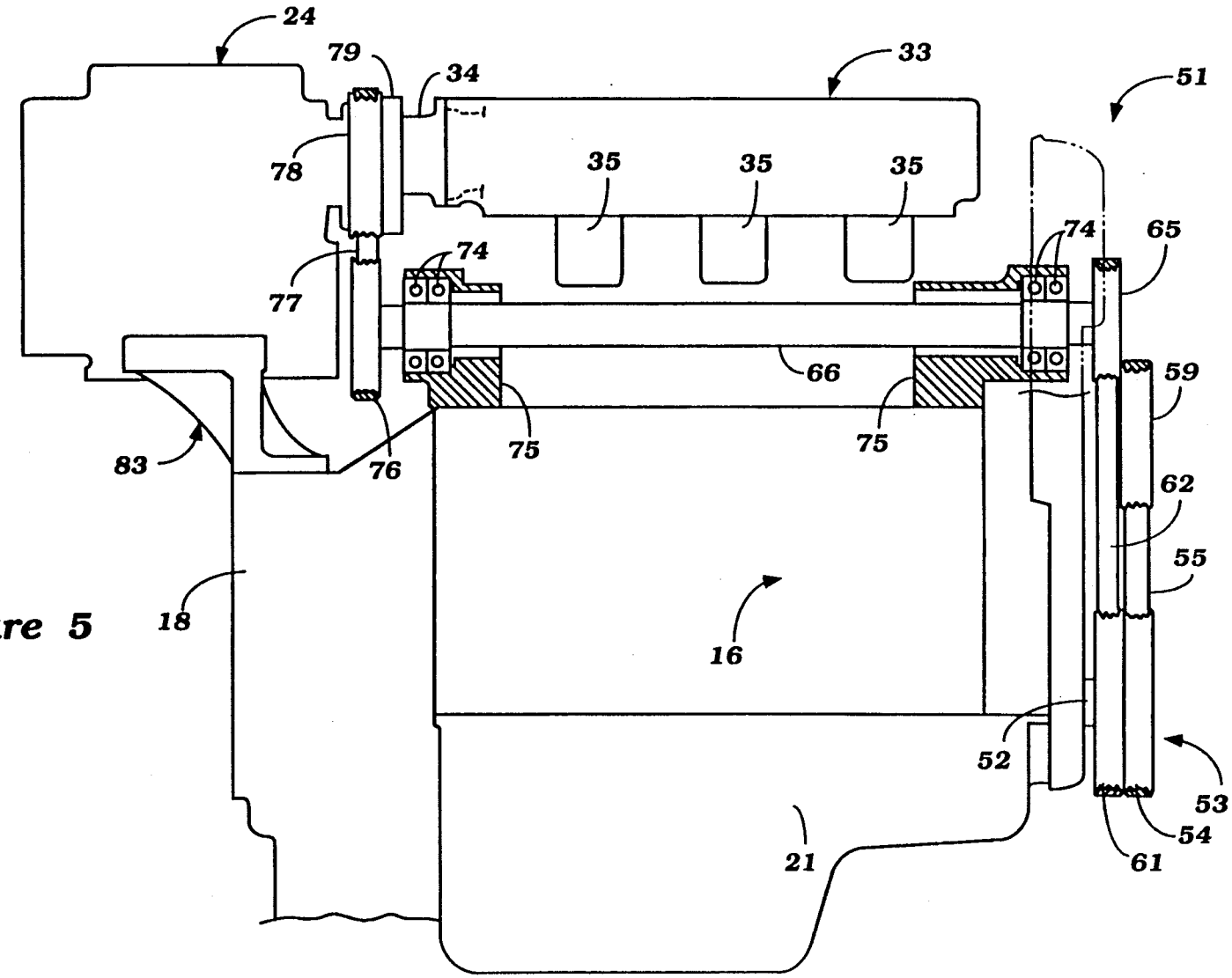
FIG. 5 is a side elevational view of this embodiment, with a portion broken away.

Referring first to the embodiment of FIGS. 1 through 3 and initially primarily to FIG. 1, a motor vehicle powered by an internal combustion engine constructed in accordance with an embodiment of the invention is identified generally by the reference numeral 11. Since the invention is directed primarily toward the construction of the engine powering the vehicle 11, the vehicle 11 has been shown only partially and in phantom. In the illustrated embodiment, the vehicle 11 is of the transverse engine, front wheel drive type and includes an engine compartment 12 having a forwardly facing air inlet opening 13. An internal combustion engine constructed in accordance with an embodiment of the invention is indicated generally by the reference numeral 14 and is positioned in the engine compartment 12 so that it entends transversely therein.

Referring now additionally to the remaining figures, the engine 14 is, in the illustrated embodiment, of the V type and has angularly disposed cylinder banks 15 and 16, each of which is formed with three cylinders. Although the invention is described in conjunction with a V-6 type engine, it is to be understood that the invention is susceptible of use in engines of other cylinder numbers and other configurations. The invention also has utility in in-line multiple cylinder engines, although certain facets of the invention have particular utility in conjunction with V- types engines.

The internal construction of the engine 14 forms no part of the invention and, for that reason, details of the internals of the engine are not illustrated, nor is description of them believed to be necessary. However, the cylinders banks 15 and 16 extend from a crankcase 17 in which a crankshaft is rotatably journaled in a known manner for rotation about an axis that extends transversely to the longitudinal center line of the vehicle 11.

This crankshaft drives a clutch that is contained within a clutch housing 18 for selectively driving an input or primary shaft 19 of a change speed transmission, indicated generally by the reference numeral 21 and which is disposed at the output end of the engine 14.

The input shaft 19 is associated with a secondary or output shaft 22 with a plurality of intermeshing gear sets 23 being provided on the shafts 19 and 22 so that the output shaft 22 can be driven at a plurality of preselected speed ratios in a known manner. Final drive is transferred from the output shaft 22 to the front wheels of the vehicle 11 in any suitable manner.

The engine 14 is provided with intake ports that face inwardly toward the valley of the V of the engine. In addition, exhaust ports are formed in the outside of the banks and communicate with exhaust manifolds 23 for the discharge of exhaust gases to the atmosphere through a suitable exhaust system (not shown) that includes the exhaust manifolds 23.

The engine 14 is provided with a supercharger assembly, indicated generally by the reference numeral 24 which is disposed above the transmission 22 and which is driven from the primary transmission shaft 19 by means of a belt 25 that is trained around a sprocket 26 fixed to the transmission primary shaft 19 and a sprocket 27 that is fixed to the input shaft 28 of the supercharger 24. As a result of the drive of the supercharger 24 from the transmission primary shaft 19, the supercharger will not be driven when the clutch is disengaged. This permits the engine to operate at a lower idle speed than were the supercharger 24 to be driven at all times and will assist in the acceleration of the vehicle.

The supercharger 24 has its inlet side facing the air inlet opening 13 of the vehicle 11. An air cleaner element 29 receives, filters and silences air that enters the air inlet opening 13 and delivers it to a throttle valve assembly 31 through a relatively short conduit 32.

The air compressed by the supercharger 24 is delivered to a plenum chamber 33 that extends between the cylinder banks 15 and 16 through a relatively short conduit 34 that enters into the plenum chamber 33 at the end of the engine adjacent the transmission 21 and opposite the end where the normal engine accessories are normally driven. As a result, the driving belt 25 need only drive the supercharger 24 and will not interfere with the driving belts of the remaining accessories.

Relatively short length runners 35 extend from the plenum chamber 33 to the individual cylinder intake ports.

Referring now to FIGS. 4 through 7, an internal combustion engine constructed in accordance with a second embodiment of this invention is identified generally by the reference numeral 51. The basic engine, supercharger and plenum chamber arrangement of this embodiment is substantially the same as the previously described embodiment and, for that reason, components which are the same or substantially the same have been identified by the same reference numerals. It should be noted that in this embodiment the inlet and outlet sides of the supercharger 24 are reversed from the previously described embodiment. However, this embodiment differs primarily from the previously described embodiment in the construction of the drive for the supercharger and for that reason only these differences will be discussed in detail.

Referring now to these figures, certain components of the engine which were not shown in the previously described embodiment have been illustrated and these include the crankshaft 52 of the engine which is journaled in the crankcase 21 in a known manner. The crankshaft 52 has at its front end a dual pulley 53 that consists of a first shieve 54 that drives a first accessory drive belt 55. The drive belt 55 drives an air conditioning compressor 56 that is disposed at one side of the engine, an alternator 57 that is disposed at this same side, an idler pulley 58 and a water pump 59.

A second shieve 61 of the pulley 53 drives an accessory drive belt 62 that drives an idler pulley 63, a power steering pump 64 and a pulley 65 that is affixed to a supercharger drive shaft 66 for driving the supercharger in a manner to be described.

The engine and specifically the crankshaft 52 drives a further sprocket 67 which drives a toothed timing belt 68 that drives toothed sprockets 69 that are affixed to intake camshafts 70 of the engine. The intake camshafts 71 are rotatably journaled in the cylinder head assemblies of the cylinder banks 15 and 16 in a known manner. The exhaust camshafts (not shown) are driven in a manner as described in U.S. Pat. No. 4,643,143, entitled "Valve Driving Means For V-Type Engine Of Vehicle", issued Feb. 17, 1987, assigned to the assignee of this application. A tensioning idler sprocket 72 also cooperates with the timing belt 68 in a known manner.

The supercharger drive shaft 66 is journaled for rotation in the valley of the V beneath the plenum chamber 33. Spaced bearings 74 are carried in pillow blocks 75 that are affixed to the cylinder block of the engine at its opposite ends for rotatably journaling the supercharger drive shaft 66. A driving sprocket 76 is affixed to the rear end of the supercharger drive shaft 66 and drives a belt 77 that drives a driven sprocket 78. The driven sprocket 78 is connected by means of a selectively engageable clutch 79 to the input shaft of the supercharger 24 for driving it. The clutch 79 may be energized in any suitable manner.

Figure 6:
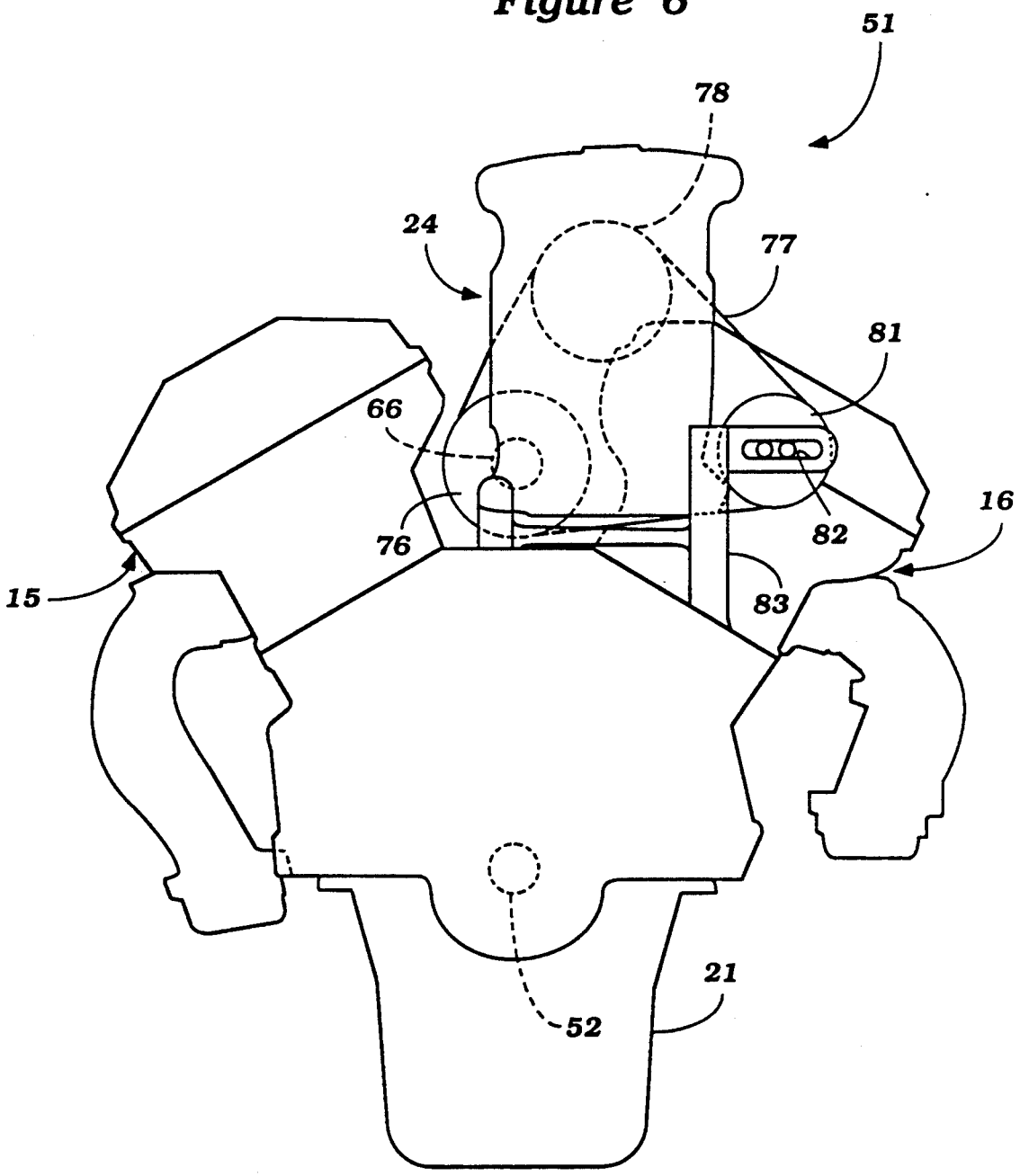
FIG. 6 is a rear elevational view of the engine of this embodiment.
Figure 7:
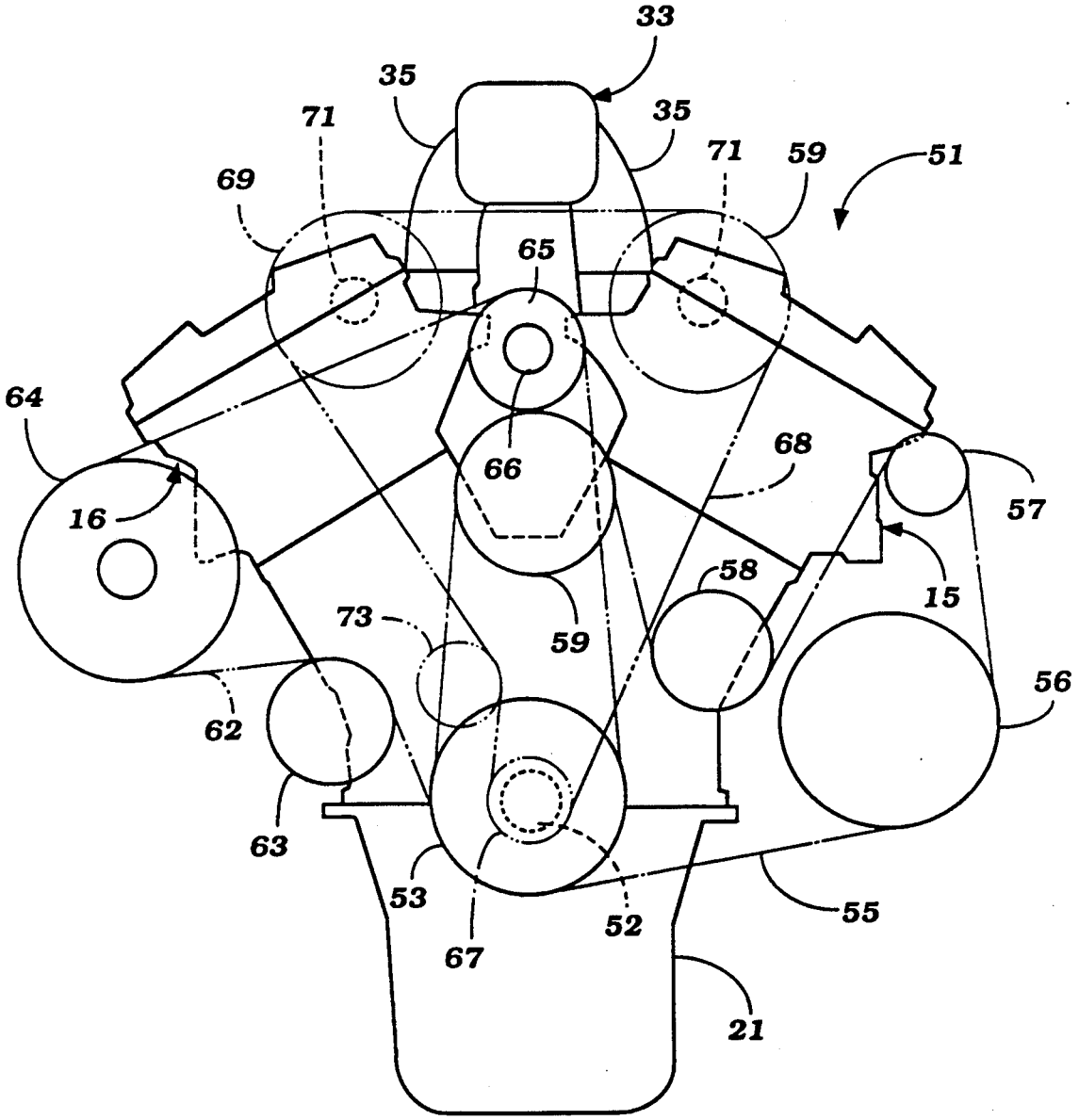
FIG. 7 is a front elevational view of the engine of this embodiment.

As seen in FIG. 6, there is provided a tensioning pulley 81 that is slidably supported in a slot 82 in a mounting bracket 83 for tensioning of the belt 77. The bracket 83 also supports the supercharger 24 on the clutch housing 18.

Figure 8:
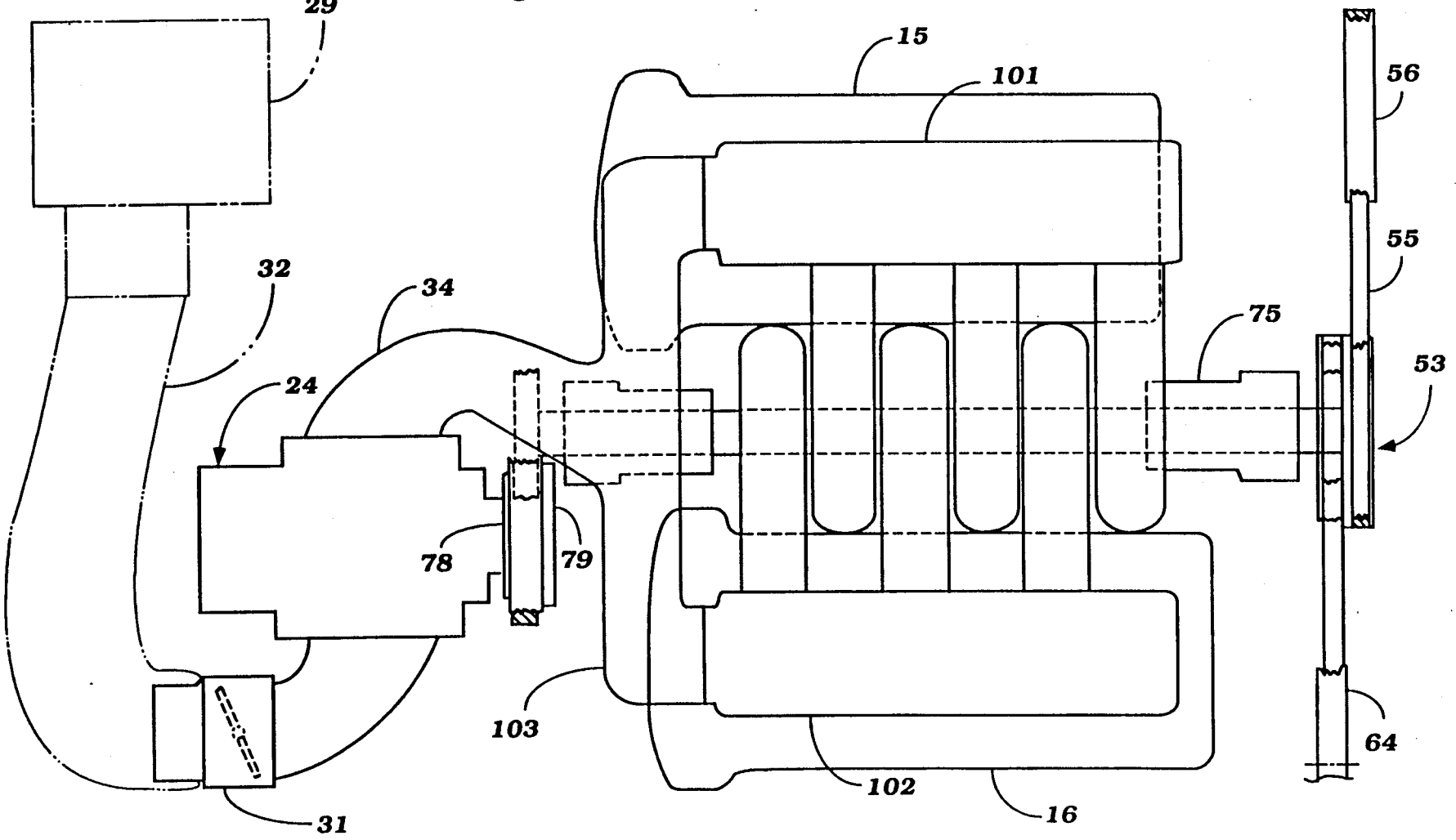
FIG. 8 is a top plan view of an internal combustion engine constructed in accordance with another embodiment of the invention.

In the embodiments thus far described, there has been provided a single plenum chamber 33 that extended between the banks of cylinders. However, the invention can also be employed in conjunction with systems wherein there are two separate plenum chambers each supported over the respective cylinder bank and such an embodiment is shown in FIG. 8. In this embodiment, the construction of the engine, supercharger and its drive is the same as the embodiment of FIGS. 4 through 7 and for that reason, those components have been identified by the same reference numerals and will not be described again. However, it is to be understood that the dual plenum chamber arrangement may also be utilized in conjunction with arrangements where the supercharger is driven off of the transmission as with the embodiment of FIGS. 1 through 3.

In this embodiment, there is a first plenum chamber 101 that is positioned above the cylinder bank 15 and a second plenum chamber 102 that is positioned above the cylinder bank 16. A Y type inlet pipe 103 interconnects the plenum chambers 101 and 102 with a supercharger outlet conduit 34. In the illustrated embodiment, the Y pipe 103 and conduit 34 are common. Of course, these components may be separate pieces.

The plenum chambers 101 and 102 cooperate with paired intake passages formed in the cylinder heads in the manner as described in U.S. Pat. No. 4,649,876, entitled "Intake Means Of Internal Combustion Engine", issued Mar. 17, 1987, assigned to the assignee of this application, wherein there is a short runner which extends from each plenum chamber 101 and 102 to an intake port of the adjacent cylinder head for each cylinder and a long runner which extends from each plenum chamber to another intake port for each cylinder of the opposite cylinder bank.

It should be readily apparent from the foregoing descriptions that a number of embodiments of the invention have been illustrated and described and each of which is effective in providing a very compact arrangement wherein plenum chambers are disposed for aligned cylinder banks and a minimum length of interconnecting conduitry is incorporated. In addition, an improved and compact type of supercharger drive arrangement has been illustrated and described.

The foregoing description is that of preferred embodiments of the invention and various changes and modifications may be made without departing from the spirit and scope of the invention, as defined by the appended claims.

I claim:

1. In an internal combustion engine for avehicle having at least one driven wheel, said engine having a plurality of aligned cylinders each containing a respective piston, an output shaft driven by said pistons, a change speed transmission at one end of said engine for driving said wheel and driven by said engine output shaft at one end thereof, a plenum chamber extending along one side of the engine and a plurality of outlets each communicating with a respective one of said cylinders, a supercharger positioned at said one end of said engine, spaced from said plenum chamber and said aligned cylinders, conduit means interconnecting an output of said supercharger with said plenum chamber inlet at said one end of said engine, and means at the other end of said engine for driving said supercharger directly from the other end of said output shaft.

2. An internal combustion engine as set forth in claim 1 wherein the engine has a pair of angularly disposed cylinder banks, each with a plurality of aligned cylinders.

3. An internal combustion engine as a set forth in claim 2 wherein the plenum chamber is positioned in the area between the banks of cylinders.

4. An internal combustion engine as set forth in claim 2 wherein there are a pair of plenum chambers each located above a respective one of the banks of cylinders and having a common inlet supplied from the supercharger.

* * * * *